US008356538B2

(12) United States Patent
Chetcuti

(10) Patent No.: US 8,356,538 B2
(45) **Date of Patent: *Jan. 22, 2013**

(54) MUNITION HANDLING APPARATUS

(75) Inventor: Raphael Joseph Francis Chetcuti, Cumbria (GB)

(73) Assignee: BAE SYSTEMS plc, London (GB)

( * ) Notice: Subject to any disclaimer, the term of this patent is extended or adjusted under 35 U.S.C. 154(b) by 0 days.

This patent is subject to a terminal disclaimer.

(21) Appl. No.: 13/121,732

(22) PCT Filed: Sep. 30, 2009

(86) PCT No.: PCT/GB2009/051275

§ 371 (c)(1),
(2), (4) Date: Mar. 30, 2011

(87) PCT Pub. No.: WO2010/038061

PCT Pub. Date: Apr. 8, 2010

(65) Prior Publication Data

US 2011/0174142 A1 Jul. 21, 2011

(30) Foreign Application Priority Data

Oct. 1, 2008 (EP) ..... 08253205
Oct. 1, 2008 (GB) ..... 0817918.6

(51) Int. Cl.
*F41A 9/39* (2006.01)
*F41A 9/44* (2006.01)

(52) U.S. Cl. ..... 89/33.05; 89/45; 89/47; 206/3

(58) Field of Classification Search ..... 89/33.01–33.5, 89/45, 47; 206/3; 102/293, 430–434, 439, 102/501

See application file for complete search history.

(56) References Cited

U.S. PATENT DOCUMENTS 3,884,119 A 5/1975 Zouck
4,558,645 A * 12/1985 Boeder et al. ..... 102/489
4,762,222 A * 8/1988 Martin ..... 206/3
4,782,758 A 11/1988 Washburn
4,803,927 A 2/1989 Washburn
4,930,422 A * 6/1990 Thouron et al. ..... 102/378
4,940,135 A * 7/1990 Hall ..... 206/3
5,779,031 A * 7/1998 Moraine et al. ..... 206/3
6,631,801 B2 * 10/2003 Boyd-Moss et al. ..... 206/204
7,308,981 B1 * 12/2007 Noel Du Payrat et al. ..... 206/3
7,422,102 B1 * 9/2008 Lam et al. ..... 206/3
8,100,255 B2 * 1/2012 Smith et al. ..... 206/3
2008/0216640 A1 9/2008 Brand et al.
2011/0174640 A1 * 7/2011 Smith et al. ..... 206/3

FOREIGN PATENT DOCUMENTS

GB 784739 A 10/1957
WO 90/15300 A 12/1990

OTHER PUBLICATIONS

International Preliminary Report on Patentability in related application PCT/GB2009/051275 mailed Apr. 5, 2011.
International Search Report in related application PCT/GB2009/051275 mailed Nov. 12, 2009.
British Search Report in related application GB0817918.6 dated Jan. 28, 2009.
European Search Report in related application EP 08 25 3205 dated Apr. 8, 2009.

* cited by examiner

*Primary Examiner* — Michael David
(74) *Attorney, Agent, or Firm* — Pillsbury Winthrop Shaw Pittman LLP

(57) ABSTRACT

There is disclosed a munition handling apparatus where the conventional ram is replaced with a high pressure fluid actuation. For this the apparatus is provided with a container that incorporates a piston which slides along the container to urge the munition out as the fluid pressure is applied.

14 Claims, 6 Drawing Sheets

MUNITION HANDLING APPARATUS

CROSS REFERENCE TO RELATED APPLICATIONS

This is the U.S. National Phase of PCT/GB2009/051275; filed Sep. 30, 2009, which claims priority to British Patent Application No. 0814918.6, filed Oct. 1, 2008 and European Patent Application No. 08253205.2 filed Oct. 1, 2008 each of which are incorporated by reference herein in their entireties.

The following invention relates to an apparatus for handling a munition and also relates, in a second aspect of the invention, to a method of loading a gun.

It is known to load a breech-loading gun by opening the breech, aligning the munition with the barrel of the gun and then using a ram to push the munition into the breech. Often the ram is formed from a solid shaft; however, rams having the form of a chain are also known.

Typically, the alignment of the munition with the barrel is facilitated by placing the munition on or within a guide. The guide acts to positively locate the munition in the aligned position prior to the ram urging the munition forwards and into the breech. The ram and the guide are components of a munition handling system. The guide may be in the form of a tray or may be in the form of a rack.

Whichever form the guide takes on, in order for the ram to be able to displace the munition from the guide at a constant velocity, it is generally necessary for the ram to be at least as long as the munition. Thus the ram may sufficiently extend into the guide to displace the munition. If the ram is to push the munition along until the munition is in the correct position in the barrel, it will need to be even longer.

Even when the munition is transferred by a 'flicking' process—where the munition is accelerated by brief contact with the ram and subsequently propelled across into the barrel under its own momentum—the ram tends to be of a length approaching that of the munition because it will most likely need to extend a substantial distance into the guide.

A gun emplacement must be provided with sufficient clearance around the breech to accommodate the ram in its full range of positions. Thus guns tend to have an added bulk associated with the ram of the handling system. This bulk increases with the size of the ram.

A further disadvantage of known rams for urging the munitions into the barrel is that the ram must be returned to a sufficient clearance (i.e. totally retracted from the guide) before the next munition on the guide can be placed in the aligned position. This tends to increase load times, particularly in guns where the munition comprises a shell portion and a charge portion which are held separately in the guide.

It is an object of the present invention to mitigate against the above identified problems associated with known munition handling apparatus by providing an improved apparatus for handling a munition.

According to a first aspect of the invention there is provided a munition handling apparatus for introducing a munition to the breech of a gun, the munition handling apparatus comprising: a container for storing a munition prior to introducing the munition to the breech; a guide for aligning the container with the breech; a source of high pressure fluid; and a connector for coupling the source to the container so as to selectively channel high pressure fluid into the container, wherein the channelling of the high pressure fluid into the container at the connector acts to eject the munition from the container.

The provision of a high pressure fluid source for ejecting the munition obviates the need for a ram that is external to the container. This advantageously provides a munition urging means which, unlike a conventional external ram, need not be retracted fully prior to moving the next container into the aligned position. A handling mechanism that doesn't have such a ram tends to reduce the time it takes for the gun to re-load and so can tend to increase the firing rate of the gun.

Moreover, because a conduit for high pressure fluids should tend to be of a smaller length than a conventional ram, the gun emplacement can tend to be less bulky.

The container of the munition handling apparatus can comprise: a generally tubular member defining a bore; a compartment for storing the munition, the compartment being defined in part by the bore; a piston for sliding along the bore; and a conduit communicating between the connector and the piston, such that the channelling of high pressure fluid into the conduit causes the piston to slide within the compartment.

Preferably the piston comprises a sealing member for maintaining a seal between an outer circumference of the piston and an inner circumference of the tubular member as the piston slides within the compartment.

This maintains the seal on the sealed conduit for the duration of the ejection. This is beneficial because the seal helps to maintain the pressure and so urge the piston onwards along the bore.

Preferably the container comprises a removable lid, such that the compartment is defined between the bore of the tubular member, the piston and the removable lid.

Advantageously, a lid can prevent the ingress of unwanted foreign matter to the compartment.

Preferably, the lid comprises a recess for accommodating a first portion of a munition, and the piston comprises a recess for accommodating a second portion of a munition, such that when the munition is accommodated by the lid or the piston, the munition is separated from the tubular member, thus defining a clearance between the munition and the tubular member.

Separating the munition from the tubular housing tends to minimise the likelihood of the munition scraping against the wall of the tubular member as the munition is ejected. Particularly where the munition is a propellant charge, such contact could damage the munition or inadvertently ignite it; avoiding such contact is therefore beneficial.

Preferably the lid is urged into the breech with the munition and if this is so, the lid is in further preference formed from a combustible material. In even further preference the lid is made of a frangible material for breaking up when the munition is fired in the gun.

Beneficially the frangible lid is rammed together with the munition into the breech of the gun wherein it is destroyed on firing of the gun. This means that the lid does not need to be separately discarded. Instead it is transferred from the container to the breech along with the munition and so a stage in the munition loading process is avoided. Therefore the loading process with a frangible lid tends to be quicker than with a lid which must be discarded outside of the breech. This acts to reduce loading times.

Unexpanded polystyrene has been identified as a material that it particularly well suited to forming the lid.

It is preferred that the piston is restrained such that it remains within the bore because thus the container remains in one piece after use and is thus apt for being reused. The piston may be restrained by a ridge protruding from the inner surface of the bore. The lid is of course discarded or destroyed and so a new lid may need to be provided at each refill of the container. However, the absence of a lid at the refill stage will make the container easier to refill insofar as there is no lid which must be removed prior to refill and so there is no lid removal process required.

Optionally, the container comprises a resilient lanyard for connecting the piston to the tubular member, such that the piston may partially slide out of the front end of the bore upon application of the high pressure fluid to the container and may consequently return to the bore upon cessation of the application of high pressure fluid to the container.

Retracting the piston into the container so that the piston is not even partially within the gun breech saves having to move the container backward prior to indexing the munition tray to align the next container with the breech. Allowing the piston to emerge partially from the bore can ensure that the munition is better located within the breech.

Optionally, the guide comprises: an arm for pivotally connecting to the gun at a first end; and a tray pivotally and slidably mounted on the arm, the tray comprising: a plurality of compartments for holding containers, wherein the guide may selectively align each of the compartments with the gun breech.

Optionally the compartment may store the munition in a sealed environment prior to ejection.

Advantageously, this allows the container to store sensitive munitions such as caseless propellant charges in a safe manner.

According to a second aspect of the invention there is provided a method for loading a gun with a munition using munition handling apparatus, the munition apparatus comprising a container comprising: a compartment for holding a munition; and an internal ram for urging the munition out of the container, the method comprising the steps of: i) aligning the container with a gun barrel and ii) applying a hydraulic pressure to the motivate the internal ram.

An embodiment of the invention will now be described by way of example only and with reference to the accompanying drawings of which:

In the drawings elements common to all the Figures have been given identical reference numerals for ease of explanation.

Figure 1:
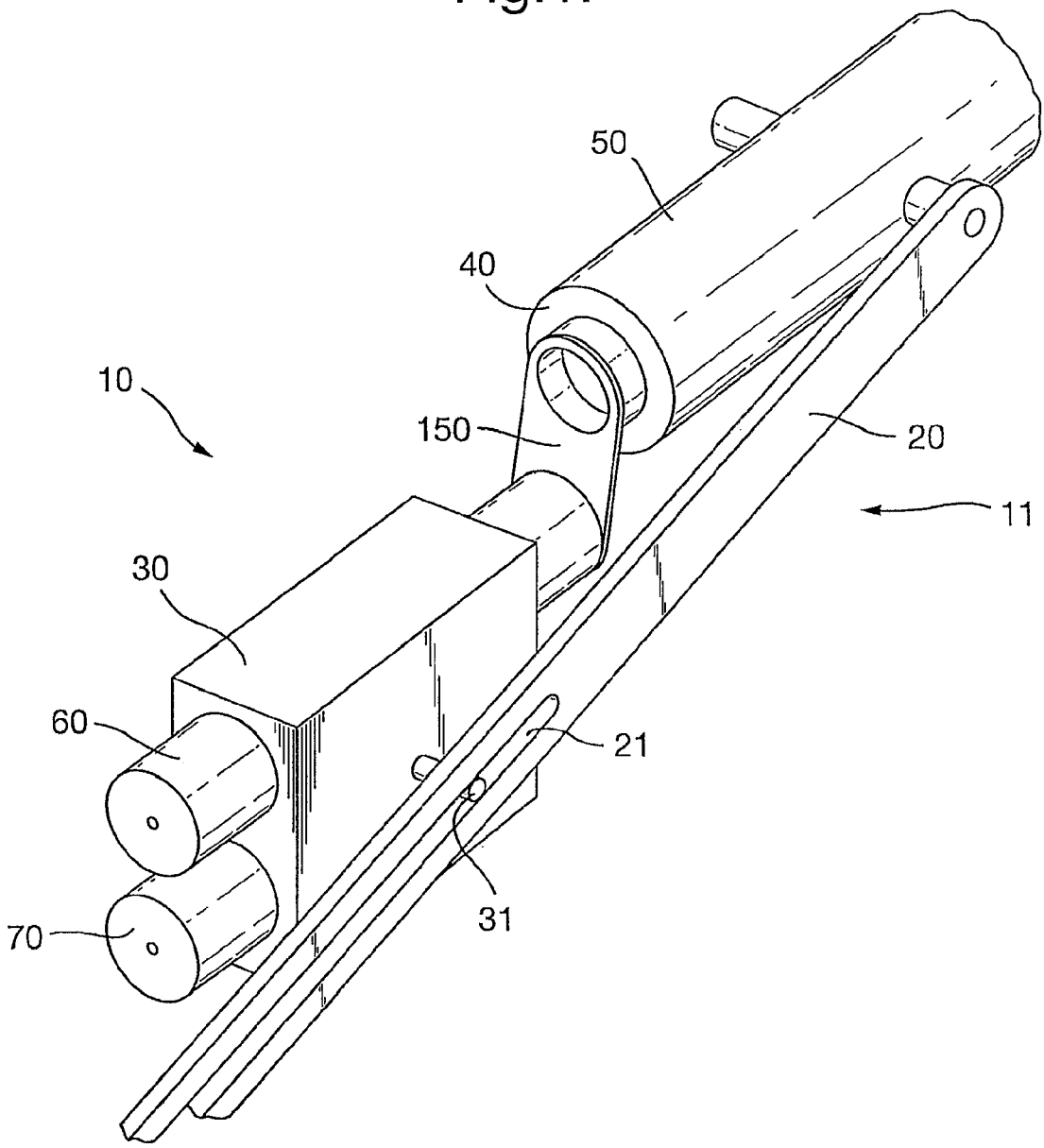
FIG. 1 is a perspective view of part of an ammunition handling system for a medium to large calibre gun.

In FIG. 1 part of an ammunition handling system, shown generally at 10, comprises a guide 11. The guide 11 in turn comprises an arm 20 and an ammunition tray 30. The arm 20 carries the tray 30. The guide 11 is moveably positioned adjacent the breech 40 of a medium calibre gun barrel 50.

The arm 20 is pivotally mounted at one end to the gun barrel 50 and is provided with a slot 21 towards its other end. A member 31 protrudes from the tray 30 into the slot 21 so that the tray 30 may slide along the arm 20 and also pivot about the member 31.

Figure 3:
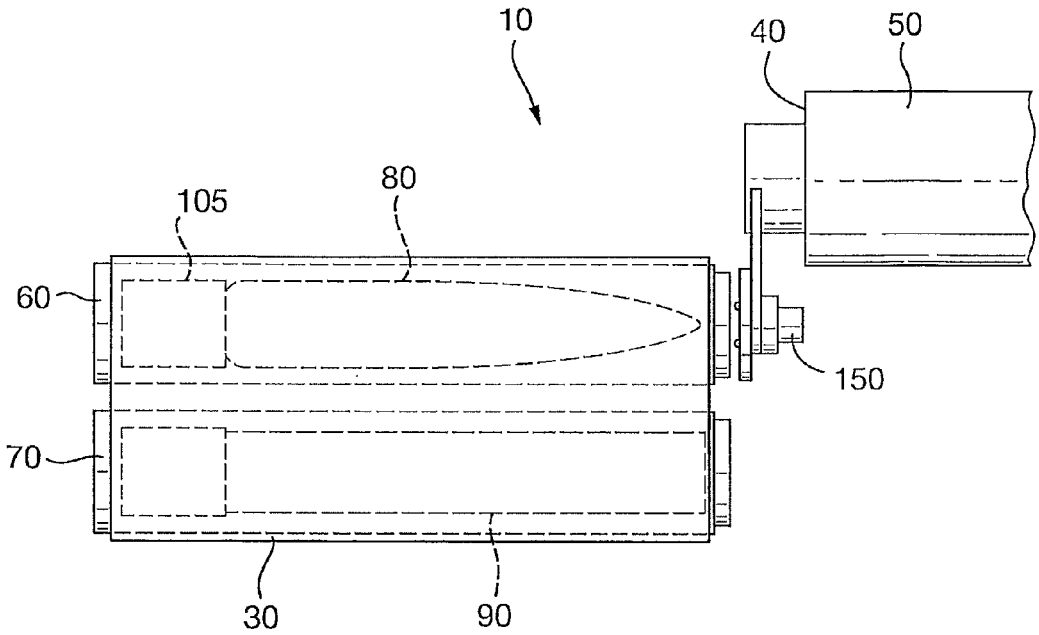
FIG. 3 is a side elevation of the part of an ammunition handling system shown in FIG. 1 in use, immediately prior to loading a round of ammunition.

Within the tray 30 are two ammunition containers 60 and 70. The tray is orientated by the system such that, immediately prior to loading, the container 60 is positioned above the other container 70. As shown in FIG. 3 initially container 60 sealably contains a shell portion 80 of a round of ammunition whilst container 70 initially contains a charge portion 90 of that round.

Figure 2:
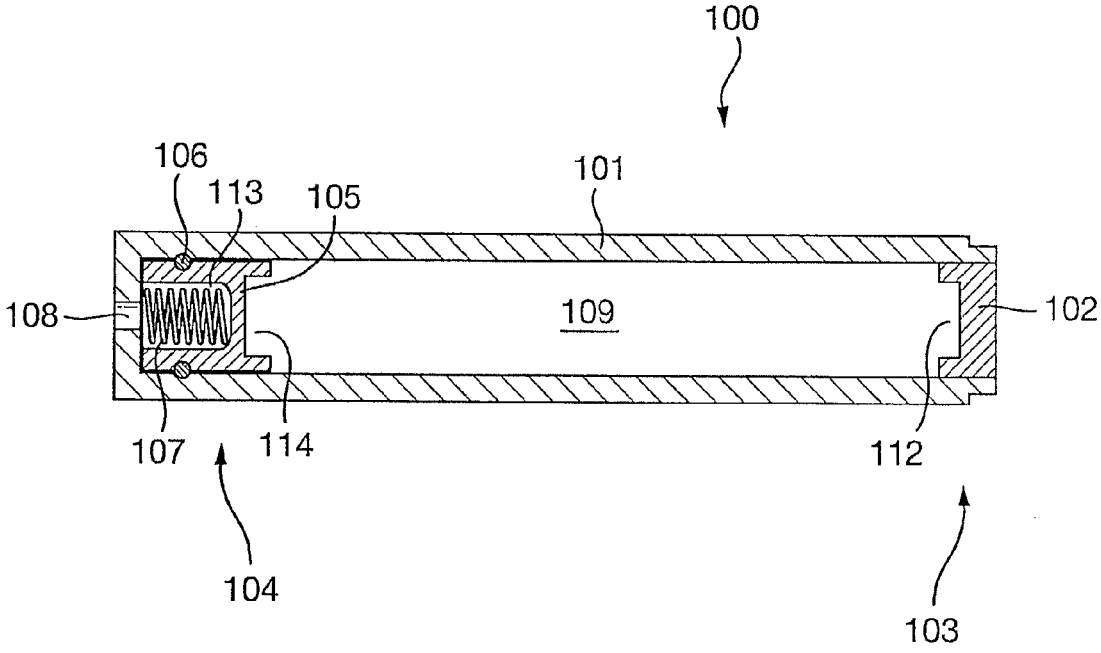
FIG. 2 is a sectioned side elevation view of an ammunition container.

An ammunition container 100 suitable for containing and deploying a shell 80, or a charge 90, or (for co-operation with an alternative handling system) a combined shell and cartridge round of traditional naval type, is shown in more detail in FIG. 2. The container 100 comprises a cylindrical housing 101 environmentally closed at one end with a lid 102 and environmentally closed at the other end by a piston 105. Thus compartment 109 for holding a munition is defined. The housing 101 and the lid 102 have co-operating threaded surfaces (not shown). The end of the container 100 to which the lid 102 is attached will be referred to for reasons which will become apparent, as the 'barrel end' 103. The end of e container 100 to which the piston 105 is attached will be referred to for reasons which will become apparent, as the 'rammer end' 104.

The piston 105 is slidably located within the inner bore of the container 100. The piston 105 has a circumferential O-ring seal 106 set into its periphery and contacting the bore. This effects the environmental closure of the compartment 109 at the rammer end 104. The seal 106, even as the piston slides, is sufficient to prevent leakage of high pressure air from the compartment 109 to the outside of the container 100 or to a chamber 113 behind the piston.

An aperture 108 with a one-way ball-valve connector (not shown) is located at the rammer end 104 of the container 100 so as to communicate with a sealed chamber 113 behind the piston 105. The connector is of a conventional type designed for releasable connection to a high pressure air supply (not shown) forming part of the handling system. Thus the aperture 108 and the sealed chamber 113 form a conduit between the high pressure air supply and the piston 105.

The container 100 may be made of any suitable material, but preferably, for operational reasons, of a non-flammable, projectile resistant material such as a steel coated with a lacquer. One suitable lacquer is Calguard "Guncoat" which is known in the art. The lacquer improves the container's resistance to corrosion and provides a low friction coating.

The rammer end of the piston 105 is connected to the closed, rammer end of the interior of the container 100 by means of a resilient lanyard 107. The length and resilience of the lanyard 107 is such that once deployed, the piston 105 is biased to be retained wholly within the container at the barrel end thereof.

The piston 105 and the end cap 102 are provided with recesses 114, 112 for accommodating a muniton. The recesses 114 and 112 form inner faces of the compartment 109 and act in combination to support the munition and to hold the munition off of the walls of the cylindrical housing 101, thereby defining a clearance that is generally constant about the circumference of the munition.

This clearance will tend to have a value depending on factors such as the calibre of the munition and the sensitivity of the munition. For a L10A2 charge (as used by the British Armed Services) which is a component of a 155 mm round, the clearance between munition and cylindrical housing 101 is in the region of 2.85 mm. The wall thickness of the cylindrical housing 101 is in the region of 1.1 mm in containers for this use.

Prior to the insertion of a munition, the container 100 is without a lid 102. The container 100 is loaded from the barrel end 103 with a shell 80 (or a charge 90, or a combined shell and cartridge) so that the piston 105 of the rammer unit is held at the rammer end 104. The container 100 is then sealed by attaching the lid 102. The insertion of the munition and the sealing with the lid 102 occurs, in general, at the munition factory. The munition is then able to be transported from the factory, stored, and later form part of an ammunition handling system without the seal having to be broken until immediately prior to loading.

It will be appreciated that if the lid 102 is removed and high pressure air applied to the channel 108 at the connector, the piston 105 will be moved longitudinally within the container 100 thereby urging the contents, i.e. the shell 80 (or charge 90, or combined shell and cartridge) within the compartment 109, out of the container 100.

One application of containers of the type described above is illustrated by FIG. 1 and the sequential loading operation FIGS. 3 to 6. FIGS. 3 to 6 are simplified figures and do not show the recesses 114 and 112 on the piston 105 and lid 102 respectively.

Figure 4:
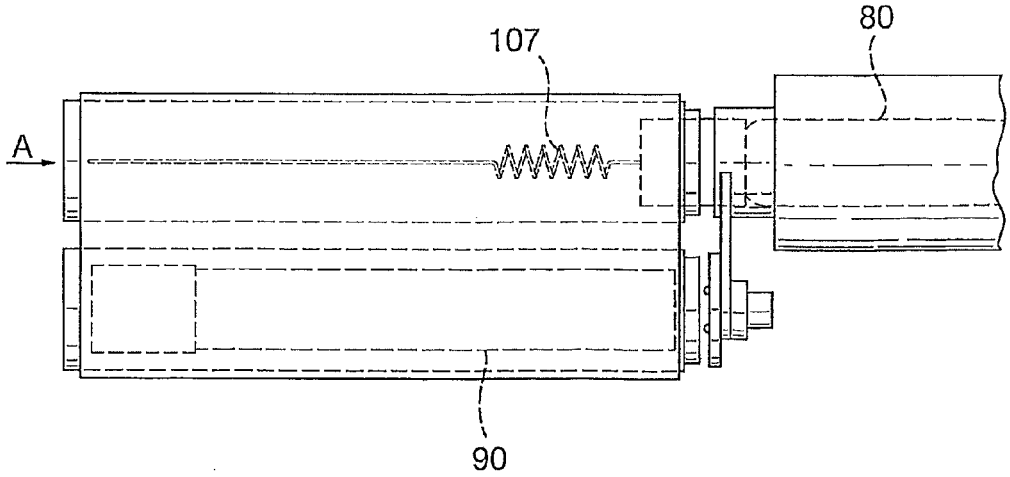
FIG. 4 is a side elevation of the system shown in FIG. 3, executing a first step in a loading operation.

A drum (not shown) on the handling system 10 is initially filled with sealed containers 60 containing shells 80 and sealed containers 70 containing charges 90. Pairs of containers, each pair consisting of a shell 80 container and a charge 90 container, are loaded into the tray 30 and carried by the arm 20 to a position adjacent the barrel of the gun 30 as shown in FIG. 3. An electric motor drive 150 connects to the lid 102 of the shell container and unscrews it. The lid 102 is discarded. The open end of the container 60 is moved adjacent to and aligned with the barrel 50 as shown in FIG. 4. Next a high pressure air line A is connected to the container 60. High pressure air is then applied through the high pressure air line. This fills the chamber 113 with air at a pressure that is greater than the air pressure of compartment 109. The pressure difference between these regions is sufficient to cause piston 105 to be displaced so as to urge the shell 80 into the barrel 50.

Figure 5:
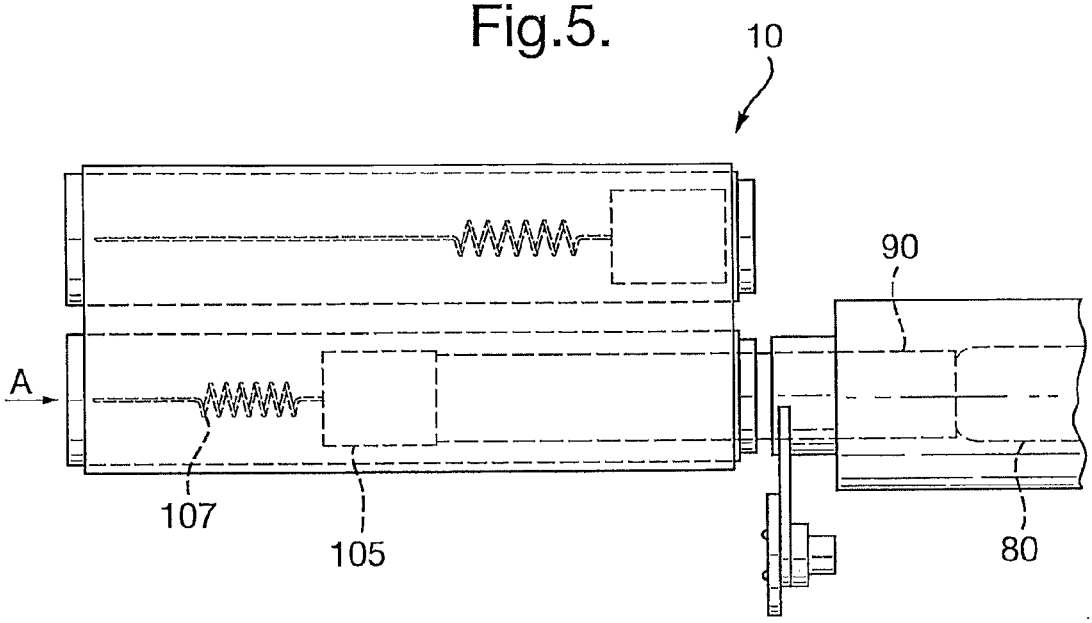
FIG. 5 is a side elevation of the system shown in FIGS. 3 and 4, executing a second step in the loading operation; and, FIG. 6 is a side elevation of the system shown in FIGS. 3, 4 and 5 on completion of the loading operation immediately prior to firing.
Figure 6:
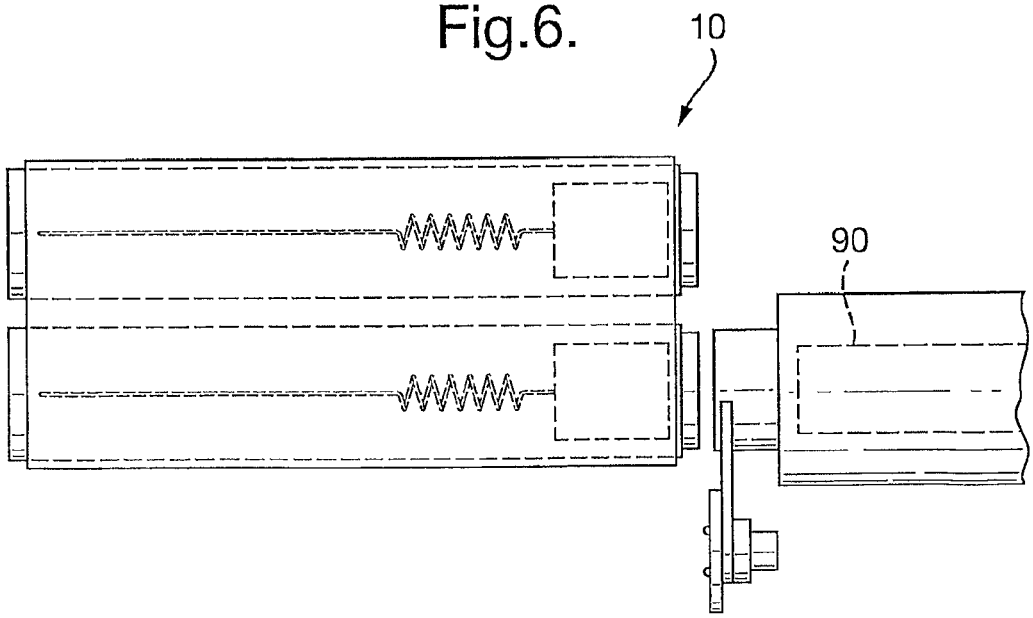

A section of the piston 105 initially moves into the barrel 50, ensuring that the end of the shell 80 is fully located in the barrel 50 as shown in FIG. 5. A ridge (not shown) protruding from the 'barrel end' of the bore of the cylindrical housing 101 prevents the piston 105 from leaving the housing 101 entirely and, as the high pressure air supply is cut-off, the resilient lanyard 107 returns the piston 105 to the interior of the container 60, clear of the interface between the barrel and the container. The tray 30 is then indexed to bring the second container 70, adjacent to and aligned with the barrel 50. In a repeat operation, its lid 102 is removed and air pressure applied. As its piston 105 deploys the charge 90 into the barrel 50, the charge 90 in turn urges the shell 80 further up the barrel 50. When the piston 105 is returned to its container 70 the tray 30 is indexed to discard both empty containers 60 and 70 for later recycling. The breech 40 is closed, the gun is fired and the operation is repeated with the next pair of containers.

A skilled man would readily be able to adapt the container and system to derive further embodiments with alternative munition transfer schemes. One such further embodiment would be where the munition could be transferred without the piston emerging from the container at all (by means of accelerating the munition through brief contact with the piston).

As an alternative to a lid which is to be removed and discarded prior to aligning the container with the breech, the lid can be formed from a material that is suitable for being placed in the barrel with the rest of the round. The provision of such a lid can accelerate the loading procedure because the step of discarding the lid (prior to aligning the container) is not required. Instead the lid can be pushed off the container and into the breech by the munition as the munition is urged forward by the piston. Such a lid is preferably made from a material which tends to completely combust once the round is fired, or at least exit the gun without leaving significant debris. Unexpanded polystyrene is a material which is suited for forming such a lid because upon firing, a lid made from polystyrene will tend to disintegrate into smaller particles. Smaller particles are more likely to fully combust or exit the gun.

Further, the interface between an unexpanded polystyrene lid and the bore of the cylindrical housing effects a seal suitable for the storing of the munition.

Figure 7:
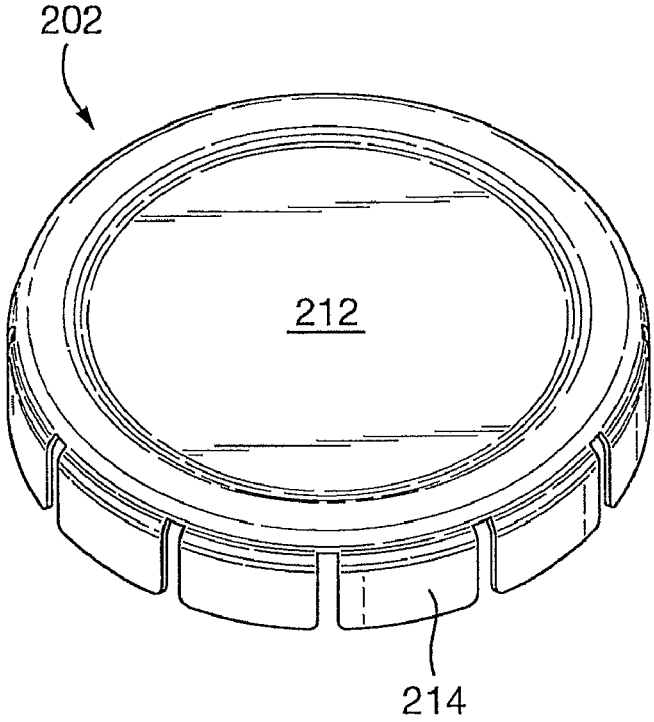
FIG. 7 is a top perspective view of a lid suitable for being placed within the barrel of the gun.
Figure 8:
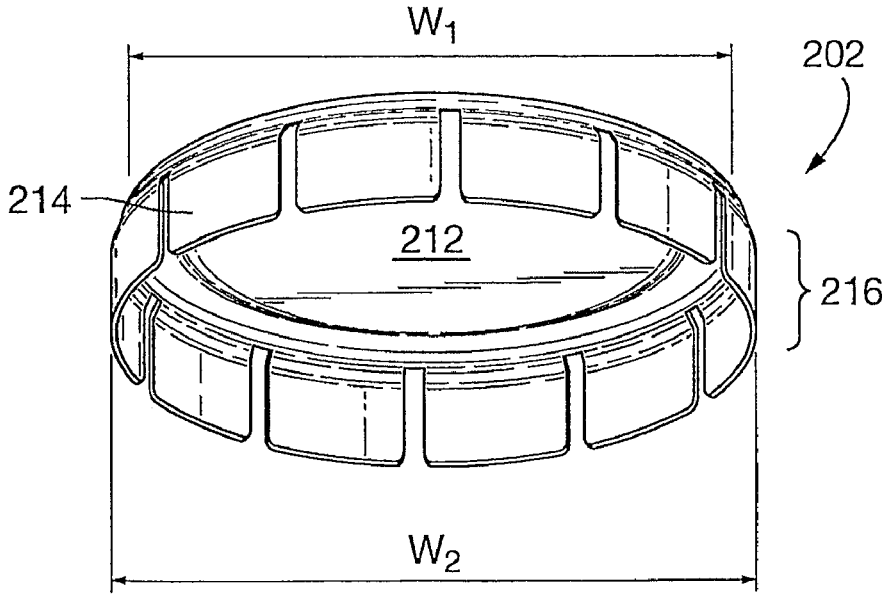
FIG. 8 is a bottom perspective view of the lid in FIG. 2.
Figure 9:
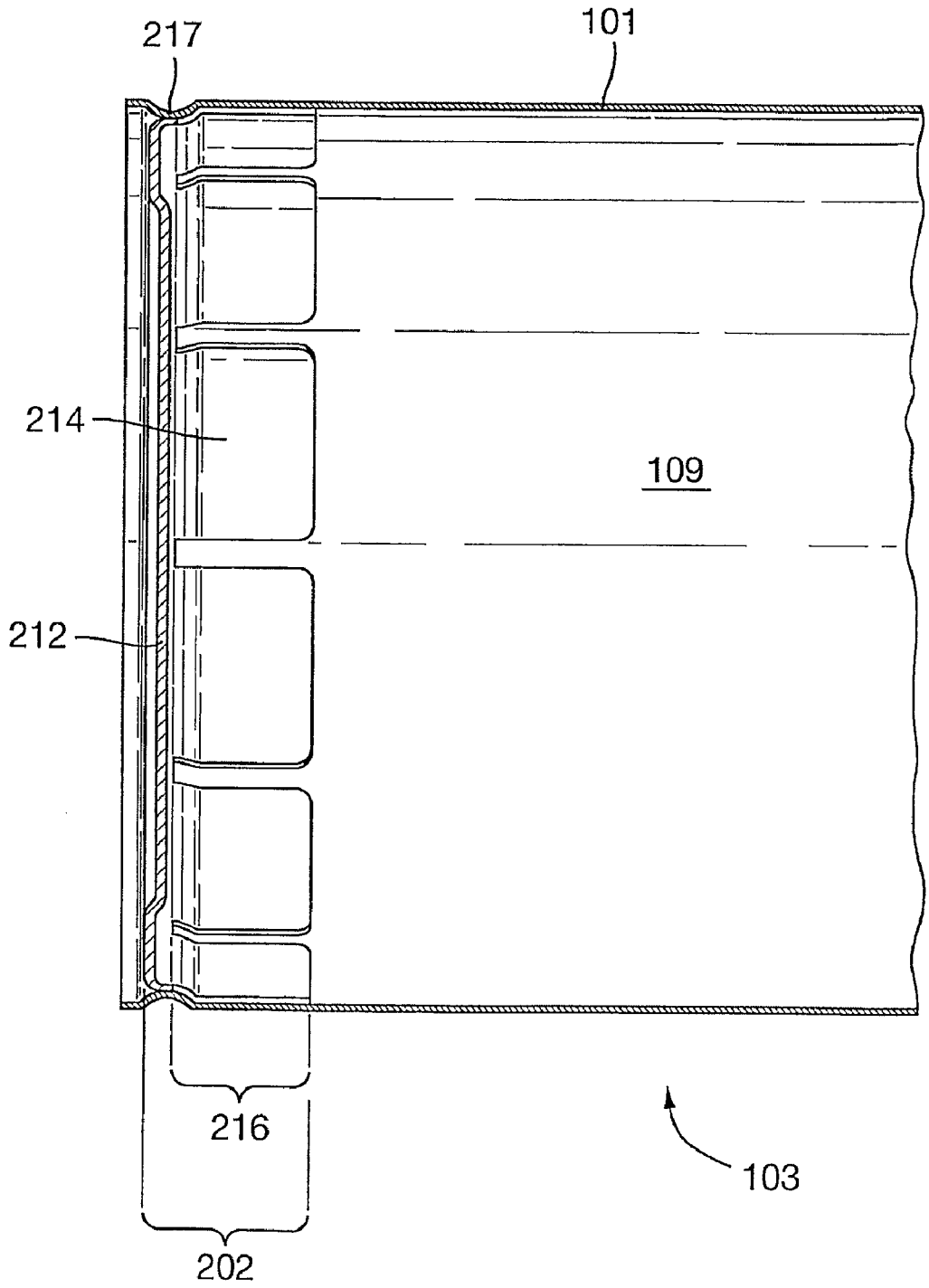
FIG. 9 is a side view of the lid in FIG. 7 inserted in the barrel of the gun.

A lid that is suitable for being placed within the barrel of the gun when it is fired is shown in FIGS. 7 to 9 and is shown in FIG. 9 disposed in an alternative form of the housing 101 to that shown in FIG. 2. In the housing 101 of FIG. 9, a ridge 217 has replaced the lanyard 107 of the housing 101 in FIG. 2 as the means for retaining the piston 105 within the housing 101.

The lid 202 has the general form of a cup, insofar as it comprises a plate section 212 and a skirt section 216. However the skirt section 216 is formed by a plurality of individually deformable tabs 214 which extend from the edge of the plate 212. The tabs 214 extend in a generally perpendicular direction but define a skirt section 216 with a slightly greater diameter $w_2$ than the plate section 212 diameter $w_1$. The region in the lid 202 where the diameter increases defines an abutting surface. The tabs are deformable so as to reduce $w_2$.

As shown in FIG. 9, when the lid 202 is placed in the container housing 101, the abutting surface rests on the ridge 217. Thus the lid 202 is held in the housing 100. So as to effect an improved airtight seal, a non-setting compound such as a silicone-based sealant or an oil-based mastic (not shown), can be applied between the lid 202 and container 101 at the abutting surface.

It will be appreciated that if the piston advances under the force of the high pressure fluid, then this will push the munition into the lid 202 and this will cause the tabs 214 to deflect so as to reduce $w_2$ so that lid 202 can move over the ridge 217. However, the ridge 217 protrudes far enough to abut the piston 105 so that it cannot exit the housing 101.

The container may be made from coated steel and formed by a flowforming process as is known in the art. However, the container can be made from other materials such as brass or carbon fibre composites. Combinations of these materials are also possible.

Where the munition handling apparatus is for handling a 155 mm calibre naval round comprising a 155 mm projectile and a separate propellant charge such as the 'L10A2', the projectile has a metal casing and is not as sensitive as the charge to the external environment The projectile therefore need not be stored in a sealed compartment; the lid 102 on container 60 need not form a seal. The propellant charge, however, is to be provided in a sealed compartment 109; the lid 102 on container 70 forms a seal.

The munition handling apparatus may of course be designed to handle rounds having a calibre other than 155 mm. A handling apparatus for handling 105 mm rounds would for example be within the scope of the invention. Where the container is for different calibre munitions, the dimensions such as clearance are scaled appropriately.

Many modifications and variations on the above example will now suggest themselves to ones skilled in the art.

The invention claimed is:

1. A munition handling apparatus for introducing a munition to the breech of a gun, the munition handling apparatus comprising:

a container for storing a munition prior to introducing the munition to the breech;

a guide for aligning the container with the breech;

a source of high pressure fluid; and a connector for selectively coupling the source to the container so as to channel high pressure fluid into the container, wherein the channelling of the high pressure fluid into the container at the connector acts to eject the munition from the container.

2. A munition handling apparatus according to claim 1 wherein the container comprises:

a generally tubular member defining a bore:

a compartment for storing the munition, the compartment being defined in part by the bore;

a piston for sliding along the bore; and a sealed conduit communicating between the connector and the piston, such that the channelling of high pressure fluid into the conduit causes the piston to slide within the compartment.

3. A munition handling apparatus according to claim 2 wherein the piston comprises a sealing member for maintaining a seal between an outer circumference of the piston and an inner circumference of the tubular member as the piston slides within the compartment.

4. A munition handling apparatus according to claim 2 wherein the container comprises a removable lid, such that the compartment is defined between the bore of the tubular member, the piston and the removable lid.

5. A munition handling apparatus according to claim 4, wherein the lid comprises a recess for accommodating a first portion of a munition, and the piston comprises a recess for accommodating a second portion of a munition, such that when the munition is accommodated by the lid or the piston, the munition is separated from the tubular member, thus defining a clearance between the munition and the tubular member.

6. A munition handling apparatus according to claim 4 wherein the lid is formed from a combustible material.

7. A munition handling apparatus according to claim 4 wherein the lid is made of a frangible material for breaking up when the munition is fired in the gun.

8. A munition handling apparatus according to claim 4 wherein the lid is formed from polystyrene.

9. A munition handling apparatus according to claim 4 wherein the piston is restrained such that it remains within the bore.

10. A munition handling apparatus according to claim 9 wherein the piston is restrained by a ridge protruding from the inner surface of the bore.

11. A munition handling apparatus according to claim 4 further comprising:

a resilient lanyard for connecting the piston to the tubular member, such that the piston may partially slide out of the front end of the bore upon application of the high pressure fluid to the container and may consequently return to the bore upon cessation of the application of high pressure fluid to the container.

12. A munition handling apparatus according to claim 4, wherein the guide comprises:

an arm for pivotally connecting to the gun at a first end;

a tray pivotally and slidably mounted on the arm, the tray comprising: a plurality of compartments for holding containers, wherein the guide may selectively align each of the compartments with the gun breech.

13. A munition handling apparatus according to claim 12 wherein the compartment stores the munition in a sealed environment prior to ejection.

14. A method for loading a gun with a munition using a munition handling apparatus for introducing a munition to the breech of the gun, the munition handling apparatus comprising a container for storing the munition prior to introducing the munition to the breech, a guide for aligning the container with the breech, a source of high pressure fluid, and a connector for selectively coupling the source to the container so as to channel high pressure fluid into the container, wherein the channeling of the high pressure fluid into the container at the connector acts to eject the munition from the container, the container comprising:

a compartment for holding the munition; and an internal ram for urging the munition out of the container, the method comprising:

i) aligning the container with a gun barrel ii) applying a hydraulic pressure to the motivate the internal ram.

* * * * *